United States Patent [19]

Kornhaus

[11] Patent Number: 4,572,505

[45] Date of Patent: Feb. 25, 1986

[54] WEIGHTED FOOT EXERCISER

[76] Inventor: Donald C. Kornhaus, Ottawa, Kans.

[21] Appl. No.: 565,891

[22] Filed: Dec. 27, 1983

[51] Int. Cl.[4] ..... A63B 23/04

[52] U.S. Cl. ..... 272/96; 272/117

[58] Field of Search ..... 272/96, 93, 117, 118, 272/134, 136, 142, 119; 128/25 R, 25 B

[56] References Cited

U.S. PATENT DOCUMENTS

| | | | |
|---|---|---|---|
| 757,983 | 4/1904 | Vaile | 272/119 X |
| 2,230,890 | 2/1941 | McClenathen . | |
| 2,285,958 | 6/1942 | Wheelock . | |
| 3,020,046 | 2/1962 | Hotas . | |
| 3,421,760 | 1/1969 | Freeman, Jr. . | |
| 3,502,329 | 3/1970 | Brazier . | |
| 3,850,430 | 11/1974 | Hamilton . | |
| 3,863,916 | 2/1975 | Cline . | |
| 3,917,261 | 11/1975 | Small . | |
| 4,200,279 | 4/1980 | Lambert | 272/118 |
| 4,266,766 | 5/1981 | Calderone . | |
| 4,337,939 | 7/1982 | Hoyle . | |
| 4,344,619 | 8/1982 | Szabo | 272/117 |
| 4,371,160 | 2/1983 | Shooltz | 272/96 |
| 4,407,496 | 10/1983 | Johnson | 272/117 |

FOREIGN PATENT DOCUMENTS

| | | | |
|---|---|---|---|
| 609109 | 6/1946 | United Kingdom | 272/96 |

*Primary Examiner*—Richard J. Apley
*Assistant Examiner*—William R. Browne
*Attorney, Agent, or Firm*—Litman, Day and McMahon

[57] ABSTRACT

An exercising device for conditioning the dorsal flexor muscles includes a fixed frame having inclined foot rests mounted adjacent one end and an arm arrangement swingably attached to the fixed frame at an opposite end. The arm arrangement includes a lever arm pivotally connected to the fixed frame and with foot engaging bars extending transversely from the lever arm generally adjacent the foot rest. The user places his feet between the foot rest and the foot engagement bars and flexes the feet upwardly to reduce the tendency toward the strained muscle condition known as shin splints. Provision is made for extra weights to be attached to the arm arrangement.

5 Claims, 4 Drawing Figures

WEIGHTED FOOT EXERCISER

This invention relates generally to exercising devices and more particularly to a device for exercising lower leg muscles, even more particularly, the dorsal flexion muscles.

BACKGROUND OF THE INVENTION

For many years, shin splints have been a common injury or condition plaguing runners. Natural body movements such as arising from a sitting position, climbing stairs, standing on the toes, running and jumping have consistently exercised the muscles of the plantar flexion including the gastro cnemius, soleus, tibialius posterior, flexor digitorum longus, and the flexor hallucis longus. These actions cause the muscles of the plantar flexion to become significantly stronger and better conditioned than the muscles of the dorsal flexion. These latter muscles include the tibialius anterior, extensor digitorum longus, extensor hallucis longus, and the peroneus tertius.

When serious training for running begins, little attention has ordinarily been given to the dorsal flexion muscles. This neglect allows the much stronger plantar flexors to overwork the dorsal flexors resulting in the tearing of the periosteum along the tibia bone. This tearing causes swelling and pain and is referred to as shin splints.

The present exercising device, when used regularly under a training program conditions the dorsal flexion muscles and balances the strength of these muscles with that of the plantar flexion muscles. Resistive exercise using the subject device should begin well in advance of hard training. The instant exercising device provides the required isolation of the dorsal flexion muscles in order that resistance can be applied effectively. Used on a regular basis, the dorsal flexors will become stronger and aid during training to significantly reduce or alleviate the problem of shin splints.

OBJECTS OF THE INVENTION

The principal objects of the present invention are: to provide an exercising device which will permit exercise of the dorsal flexion muscles; to provide such a device which is of such construction that it is relatively low in cost to permit the individual runner to afford such a device; to provide such an exercising device which is portable and may be easily stored; to provide such a device which is compact in size and requires a minimum of space; to provide such an exercising device in which the resistive weight thereof can be varied as muscles become conditioned; and to provide such an exercising device which is sturdy and efficient in use and paricularly well adapted for the intended purpose.

Other objects and advantages of this invention will become apparent from the following description taken in conjunction with the accompanying drawings wherein are set forth, by way of illustration and example, certain embodiments of this invention.

DESCRIPTION OF THE PREFERRED EMBODIMENT

Figure 1:
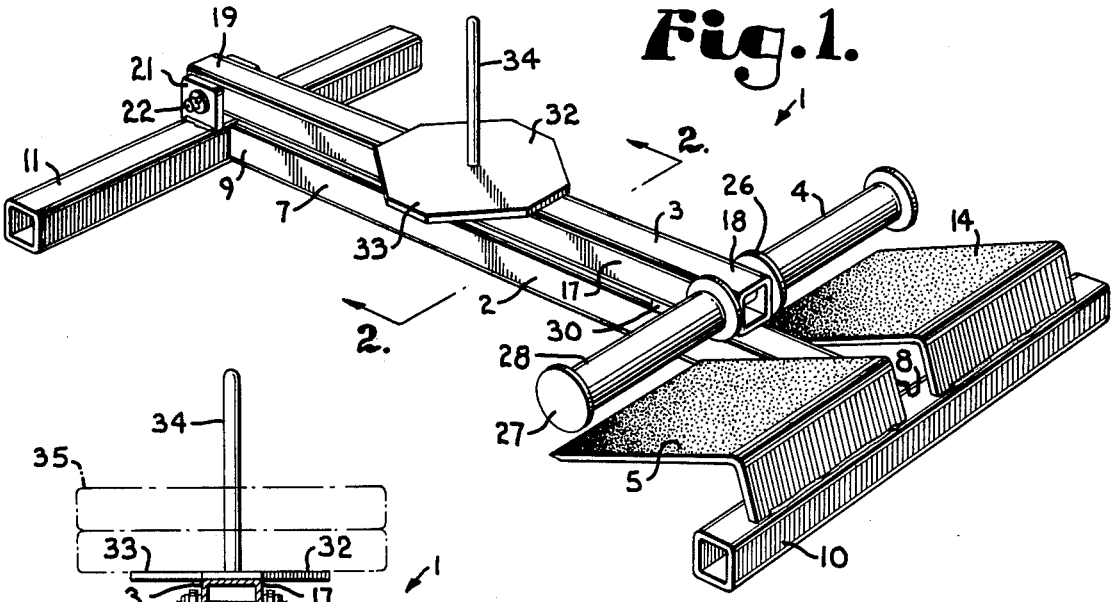
FIG. 1 is a perspective view of the lower leg exercising device embodying the present invention.

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail:

The reference numeral 1, FIG. 1, generally indicates a foot exercisor or dorsal flexor muscle conditioner embodying the present invention. The muscle conditioner 1 generally includes a fixed frame 2 and a pivotally mounted arm arrangement 3 with foot engaging bars 4 projecting outwardly and generally positioned over foot rests 5. The foot engaging bars and rests 5 are spaced a sufficient distance to permit a user's foot to extend therebetween, FIG. 4, whereupon the user rotates his or her foot upwardly, leaving the heel on the foot rest 5, to exercise the muscles of the dorsal flexion group. The arm arrangement 3 swings upwardly in response to muscle tension and provides the additional weight for effective exercise.

In the illustrated example, the fixed frame 2 is generally in the form of an I and is of square tubular steel and which may be secured in the depicted relationship by means of welding or the like. The fixed frame 2 includes a longitudinal frame member 7 with front and rear ends 8 and 9 respectively secured to front and rear end members 10 and 11 extending transversely to the longitudinal frame member 7 and extending perpendicularly thereto. The fixed frame 2 is designed to lay flat upon a floor, FIG. 4.

The foot rests 5 are spaced, positioned on opposite sides of the longitudinal frame member 7 and mounted thereto. The foot rests 5 are respectively in the shape of an inverted, reclining L and include a leg portion 14 attached to the front end member 10 as by welding and extending upwardly therefrom. Each foot rest 5 has a foot supportive surface 14 inclined toward the rear end member 11, thereby providing a sloping surface for downward pointing of the feet. The surface 14 may be covered with a non-slip coating or pad. The leg portion 13 also provides an area for engagement of a shoe heel should the user be wearing shoes with raised heels.

The arm arrangement 3 include a lever arm 17 as its main member and which has a front end 18 and a rear end 19. The rear end 19 is attached by pivot means to the fixed frame 2 so that the lever 17 swings upwardly and downwardly away from and toward the longitudinal frame member 7. In the illustrated example, the pivot means includes spaced ears 21 affixed to and extending upwardly from a medial portion on the rear end member 11. The lever arm rear end 19 is positioned between the ears 21 to be coplanar with the longitudinal frame member 7. A pivot bolt 22 extends through the lever arm 19 and the ears 21 and is suitably affixed so as to provide a pivot.

Figure 3:
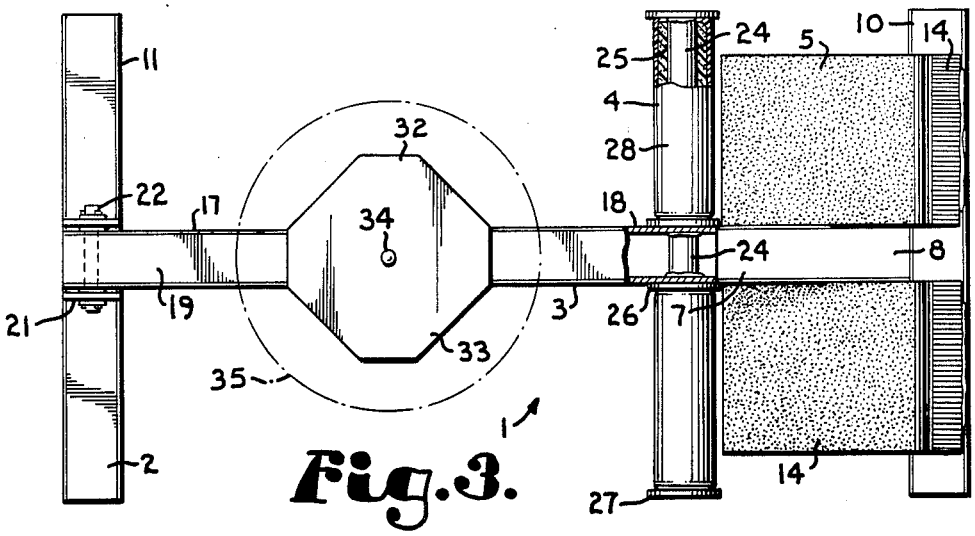
FIG. 3 is a plan view of the device.

The lever arm 17 is of a shorter length than the longitudinal frame member 7 and has the foot engaging bars 4 positioned at its front end 18. In the illustrated example, FIG. 3, the foot engaging bars 4 are two in number and mounted upon a single shaft 24 extending through the lever arm 17. Respective sleeves 25 are suitably mounted on the shaft 24 for rotation, as when the user rotates his foot. Suitable inner and outer washer-like plates 26 and 27 maintain the foot centered on the bars 4. The covering 28 overlies the bars 4 and provides cushioning.

Figure 4:
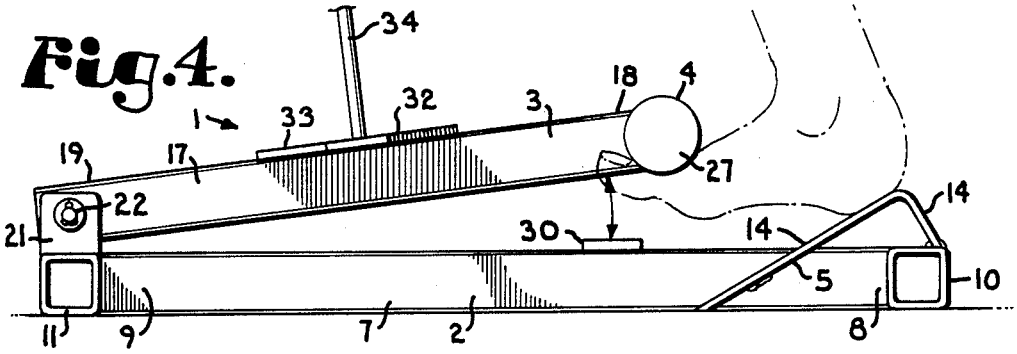
FIG. 4 is a side elevational view of the device showing its manner of use.

In the lowered position, FIG. 1, the foot engaging bars are spaced a slight distance above the foot rest 5 whereby the user may position his foot therebetween and rotate the foot upwardly, FIG. 4, to swing the arm arrangement 3 upwardly and provide additional resistive force to condition the lower leg muscles. Preferably, a pad 30, FIGS. 1 and 4, is positioned under the front end 18 of the lever arm 17 and into contact with an intermediate portion of the longitudinal frame member 7 so that the lever arm engages the same quietly while in use.

Figure 2:
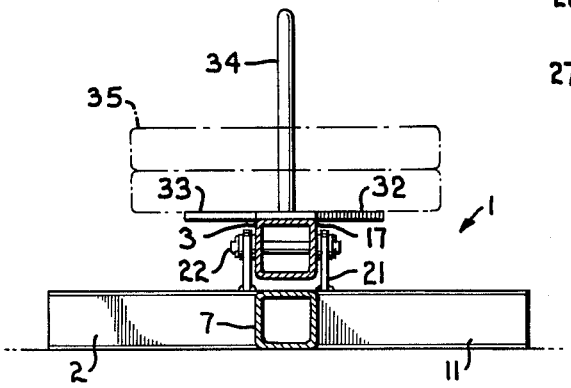
FIG. 2 is an enlarged, cross-sectional view taken along lines 2—2, FIG. 1.

To provide additional resistive weight, a weight holder 32 is positioned intermediately on the lever arm 17 and in the illustrated example includes a base 33 of plate form and a central upright shaft 34. Common disc weights 35, FIG. 2, are positioned upon the upright shaft 32. The weight may be varied to suit the particular user.

In use, the user places his foot upon the foot rest 5 so that the toes are generally under the foot engaging bars 4 and flexes his feet upwardly, isolating the dorsal flexion muscle group. A series of toe lift rocking foot motions directs exercising the dorsal flexion muscles so that they become stronger in order to reduce and alleviate the problem of shin splints in runners.

It is to be understood that while certain forms of the present invention have been illustrated and described herein, it is not to be limited to the specific forms or arrangement of parts described and shown.

What is claimed and desired to be secured by Letters Patent is as follows:

1. A lower leg exercising device comprising:

(a) a fixed frame including a longitudinal frame member and front and rear frame end members extending transversely, said fixed frame generally lying flat upon a floor;

(b) spaced foot rests mounted to said front end member and having a foot supportive surface inclined toward said rear end member; said foot rests being spaced about said longitudinal frame member; and having a lever arm and pivot means extending from said rear end member; said lever arm being rotatable toward and away from said longitudinal frame member;

(d) foot engaging bars with rotative sleeves thereon extending transversely from said lever arm generally adjacent said front end member; said bars being spaced from said foot rests a distance sufficient for a foot to be positioned therebetween whereby when said foot is flexed, said arm arrangement swings upwardly; and (e) a weight holder positioned intermediately on said lever arm and including an upright shaft for receiving disc weights.

2. A lower leg exercising device comprising:

(a) a fixed frame including a longitudinal frame member and front and rear end members extending transversely;

(b) spaced foot rests mounted to said front end member and having a foot supportive surface inclined toward said rear end member;

(c) an arm arrangement swingably attached to said fixed frame and having a lever arm and pivot means extending generally from said rear end member; said lever arm being rotatable toward and away from said longitudinal frame member;

(d) foot engaging bars extending transversely from said lever arm generally adjacent said front end member; said bars being spaced from said foot rests a distance sufficient for a foot to be positioned therebetween whereby when said foot is flexed, said arm arrangement swings upwardly and provides weight to exercise the muscles of said lower leg; and (e) a weight holder mounted intermediately on said lever arm and including a base and an upright shaft extending therefrom for receiving disc weights.

3. The exercising device set forth in claim 2 wherein:

(a) said pivot means includes spaced ears extending upwardly from said rear end member with said lever arm mounted therebetween by a pivot bolt.

4. The exercising device set forth in claim 2 wherein:

(a) said foot engaging bars include rotatable sleeves extending thereover to facilitate movement between said foot and said bars;

(b) said sleeves have padding thereon for comfort.

5. The exercising device set forth in claim 2 including:

(a) a pad of shock absorbant material mounted between said longitudinal frame member and said lever arm adjacent said foot engaging bars for reduction of noise.

* * * * *